US009946223B2

(12) United States Patent
Kojima et al.

(10) Patent No.: US 9,946,223 B2
(45) Date of Patent: Apr. 17, 2018

(54) COOLING DEVICE AND IMAGE FORMING APPARATUS INCORPORATING THE COOLING DEVICE

(71) Applicants: Reo Kojima, Kanagawa (JP); Katsuhiro Hoshi, Kanagawa (JP); Tomoyuki Nishikawa, Saitama (JP)

(72) Inventors: Reo Kojima, Kanagawa (JP); Katsuhiro Hoshi, Kanagawa (JP); Tomoyuki Nishikawa, Saitama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/200,013

(22) Filed: Jul. 1, 2016

(65) Prior Publication Data

US 2017/0010582 A1 Jan. 12, 2017

(30) Foreign Application Priority Data

Jul. 8, 2015 (JP) ..... 2015-137127
Jul. 8, 2015 (JP) ..... 2015-137128

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS 3,817,159 A * 6/1974 Bennett ..... F24F 7/08 138/116
3,982,583 A * 9/1976 Shavit ..... F24F 11/0001 165/249
4,076,073 A * 2/1978 Yamamoto ..... F24D 11/0285 165/53
4,157,112 A * 6/1979 Swiderski ..... F24F 3/00 165/214

(Continued)

FOREIGN PATENT DOCUMENTS

JP 2001-005354 1/2001
JP 2004-004574 1/2004

(Continued)

*Primary Examiner* — G. M. Hyder
(74) *Attorney, Agent, or Firm* — Harness, Dickey & Pierce, P.L.C.

(57) ABSTRACT

A cooling device, which is included in an image forming apparatus, includes a cooling device including an air blower, an airflow divider, an air flowing passage, and an air exhaust opening. The air blower blows air toward a cooling target device. The airflow divider divides the air exhausted from the air blower into at least two airflows such that an air flowing direction of the air is changed to a direction perpendicular to an air exhausting direction of the air. The at least two airflows pass through the air flowing passage. A wall of the air flowing passage is disposed facing the cooling target device. The air exhaust opening is disposed on the wall of the air flowing passage to cause the air to pass through toward the cooling target device disposed in a direction intersecting the air flowing direction in the air flowing passage.

19 Claims, 10 Drawing Sheets

(56) References Cited

U.S. PATENT DOCUMENTS

| | | | | | |
|---|---|---|---|---|---|
| 4,616,557 | A * | 10/1986 | Paoluccio | F24F 7/007 | 454/230 |
| 4,739,624 | A * | 4/1988 | Meckler | F24D 11/0257 | 62/160 |
| 5,368,072 | A * | 11/1994 | Cote | F16K 11/0655 | 137/872 |
| 6,327,867 | B1 * | 12/2001 | Hyodo | F25B 5/04 | 62/187 |
| 2003/0185585 | A1 | 10/2003 | Kimura et al. | | |
| 2007/0074525 | A1 * | 4/2007 | Vinson | H05K 7/20745 | 62/259.2 |
| 2011/0064449 | A1 * | 3/2011 | Shimizu | G03G 15/2017 | 399/92 |
| 2013/0227966 | A1 * | 9/2013 | Ayres | F25B 21/02 | 62/3.2 |
| 2014/0140719 | A1 * | 5/2014 | Suzuki | G03G 15/0189 | 399/92 |
| 2016/0291541 | A1 * | 10/2016 | Yamashita | G03G 21/206 | |

FOREIGN PATENT DOCUMENTS

| | | |
|---|---|---|
| JP | 2013-238735 | 11/2013 |
| JP | 2014-106352 | 6/2014 |

* cited by examiner

COOLING DEVICE AND IMAGE FORMING APPARATUS INCORPORATING THE COOLING DEVICE

CROSS-REFERENCE TO RELATED APPLICATIONS

This patent application is based on and claims priority pursuant to 35 U.S.C. § 119(a) to Japanese Patent Application Nos. 2015-137127, filed on Jul. 8, 2015, and 2015-137128, filed on Jul. 8, 2015, in the Japan Patent Office, the entire disclosure of each of which is hereby incorporated by reference herein.

BACKGROUND

Technical Field

This disclosure relates to a cooling device and an electrophotographic image forming apparatus such as copier, printer, facsimile machine, which can include the cooling device.

Related Art

Various types of image forming apparatuses include copiers, printers, facsimile machines, or multifunction peripherals (MFPs) having two or more of copying, printing, scanning, facsimile transmission, plotter, and other capabilities. Such image forming apparatuses include a cooling device having a technique to cool a cooling target body or device. From a view point of power consumption and cost, a single cooling device is used in the image forming apparatus to blow air toward multiple cooling target bodies via air flowing passages of respective branched ducts.

SUMMARY

At least one aspect of this disclosure provides a cooling device including an air blower, an airflow divider, an air flowing passage, and an air exhaust opening. The air blower blows air toward a cooling target device and has an air exhaust port. The airflow divider divides the air exhausted from the air exhaust port of the air blower into at least two airflows such that an air flowing direction of the air is changed to a direction perpendicular to an air exhausting direction of the air. The air flowing passage is a passage through which the at least two airflows divided by the airflow divider pass. The air flow passage has a wall disposed facing the cooling target device. The air exhaust opening is disposed on the wall of the air flowing passage to cause the air to pass through toward the cooling target device disposed in a direction intersecting the air flowing direction in the air flowing passage.

Further, at least one aspect of this disclosure provides an image forming apparatus including a developing device including an image bearer to bear a toner image, a fixing device to fix the toner image transferred from the image bearer onto a recording medium, and the above-described cooling device disposed between the developing device and the fixing device.

Further, at least one aspect of this disclosure provides a cooling device including an air blower, a first air flowing passage, and a second air flowing passage. The air blower blows air toward a cooling target device and has an air exhaust port. The first air flowing passage and the second air flowing passage flow the air exhausted from the air blower. Each of the first air flowing passage and the second air flowing passage extend in an air flowing direction perpendicular to an air exhausting direction of the air. The second air flowing passage has a wall disposed facing the cooling target device and an air exhaust opening that is disposed on the wall to cause the air to pass through toward the cooling target device. The first air flowing passage is disposed between the second air flowing passage and a heat generator included in an image forming apparatus and is aligned with the second air flowing passage.

Further, at least one aspect of this disclosure provides an image forming apparatus including a developing device, a fixing device, and the above-described cooling device. The developing device includes an image bearer to bear a toner image and is the cooling target device. The fixing device fixes the toner image transferred from the image bearer onto a recording medium and is the heat generator. The above-described cooling device is disposed between the developing device and the fixing device.

Further, at least one aspect of this disclosure provides a cooling device including an air blower, a first cover, and a second cover. The air blower blows air toward a cooling target device and has an air exhaust port. The first cover and the second cover is disposed between which the air blower is held. The second cover includes a first air flowing passage and a second air flowing passage to flow the air exhausted from the air blower. Each of the first air flowing passage and the second air flowing passage extend in an air flowing direction perpendicular to an air exhausting direction of the air exhausted from the air blower. The second air flowing passage has a wall and an air exhaust opening that is disposed on the wall to cause the air to pass through toward the cooling target device.

Further, at least one aspect of this disclosure provides an image forming apparatus including a developing device, a fixing device, and the above-described cooling device. The developing device includes an image bearer to bear a toner image and is the cooling target device. The fixing device fixes the toner image transferred from the image bearer onto a recording medium and is the heat generator. The above-described cooling device is disposed between the developing device and the fixing device.

DETAILED DESCRIPTION

Figure 1:
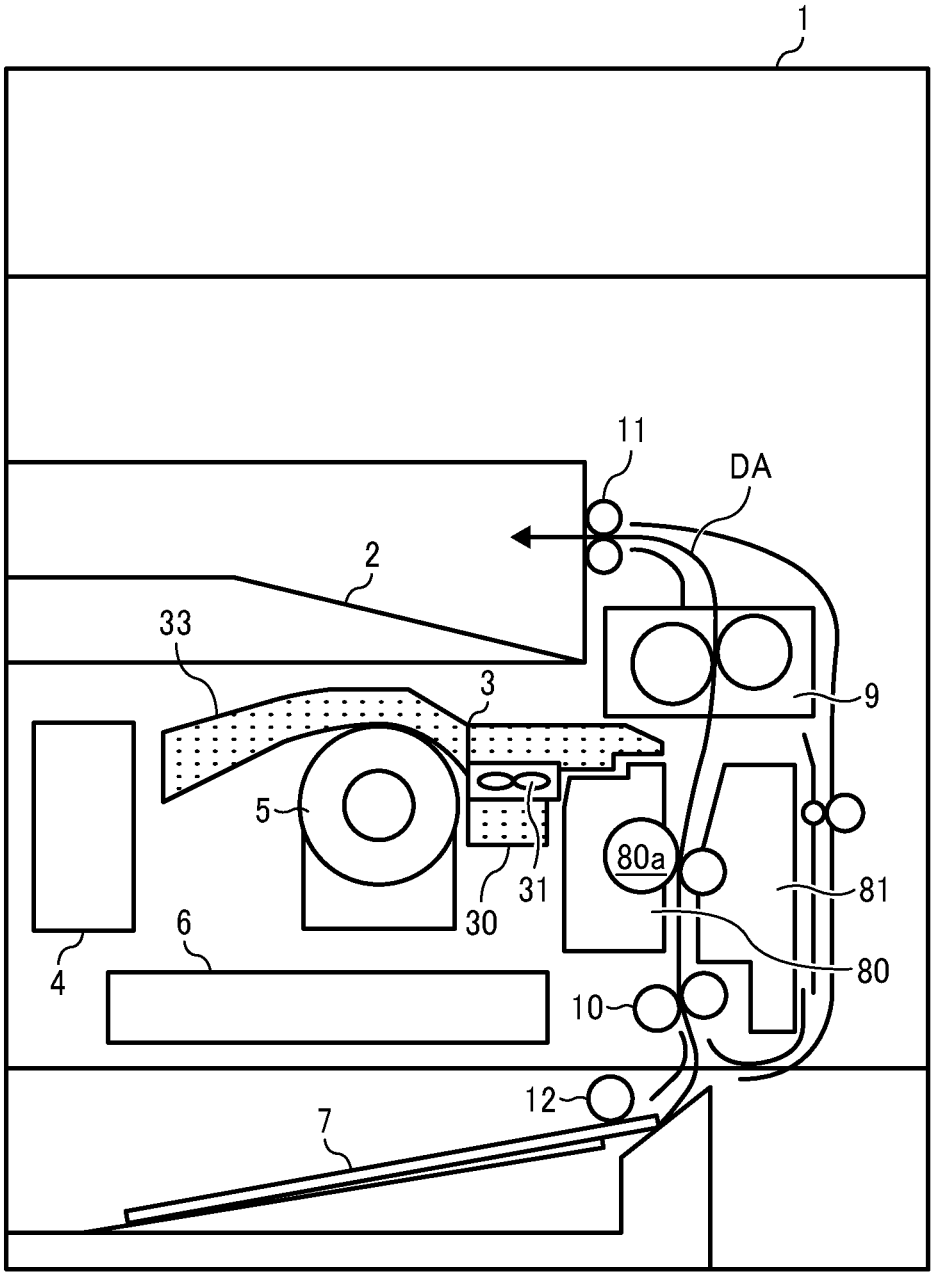
FIG. 1 is a schematic diagram illustrating an entire configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus 1 according to the present embodiment of this disclosure, with reference to drawings.

FIG. 1 is a schematic diagram illustrating an entire configuration of the image forming apparatus 1 according to an embodiment of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

A recording sheet 7 that functions as a print medium and a recording medium is accommodated in a sheet feeding part disposed in a lower part of the image forming apparatus 1.

A sheet conveying roller 10 is disposed downstream from the sheet feeding part in a sheet conveying direction DA.

At the start of a printing operation, a pickup roller 12 rotates to pick up the recording sheet 7 to feed the recording sheet 7 to a transfer position located between a developing device 80 and a transfer unit 81. The developing device 80 includes a photoconductor drum 80*a* therein. The photoconductor drum 80*a* functions as an image bearer to bear a toner image on a surface thereof. The transfer unit 81 transfers the toner image formed on the surface of the photoconductor drum 80*a* onto the recording sheet 7.

A fixing device 9 is disposed downstream from the developing device 80 and the transfer unit 81 in the sheet conveying direction DA. The fixing device 9 fixes the unfixed toner image formed on the recording sheet 7 to the recording sheet 7 by application of heat and pressure. The fixing device 9 includes a fixing roller that functions as a fixing body and a pressure roller that functions as a pressing body.

A sheet ejection roller 11 is disposed downstream from the fixing device 9 in the sheet conveying direction DA. The sheet ejection roller 11 ejects and stacks the recording sheet 7 with the fixed toner image to a sheet ejection part 2.

A cooling device 3 is disposed below the sheet ejection part. A toner bottle 5 that contains toner is disposed below the cooling device 3. A printed circuit board 4 is disposed at a left side of the cooling device 3. The printed circuit board 4 controls parts and components in the image forming apparatus 1. An exposure device 6 is disposed below the toner bottle 5. The exposure device 6 emits laser light based on image data read by a document reading device disposed in an upper part of the image forming apparatus 1, so as to irradiate the surface of the photoconductor drum 80*a*.

The cooling device 3 includes an air intake guide 30, an air blowing fan 31, a first duct 32, and a second duct 33. The cooling device 3 cools the developing device 80 and the printed circuit board 4.

In the present embodiment, the cooling device 3 is disposed at a location to cool the developing device 80 and the printed circuit board 4, each of which functions as a cooling target device. However, the cooling target device is not limited thereto and may be applied to any other parts and components included in the image forming apparatus 1 according to the present embodiment of this disclosure.

Figure 2:
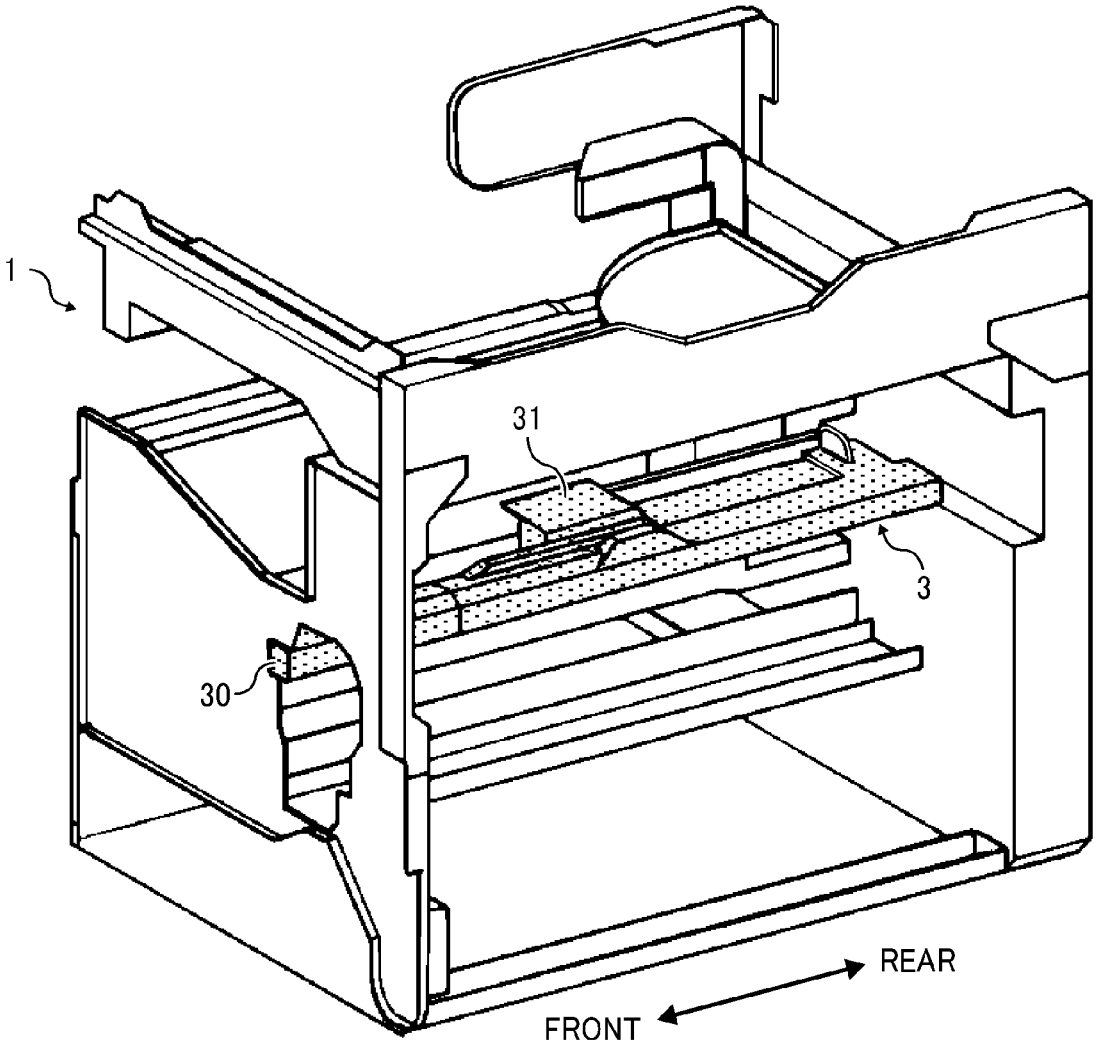
FIG. 2 is a schematic diagram illustrating a location of a cooling device in the image forming apparatus.
Figure 3B:
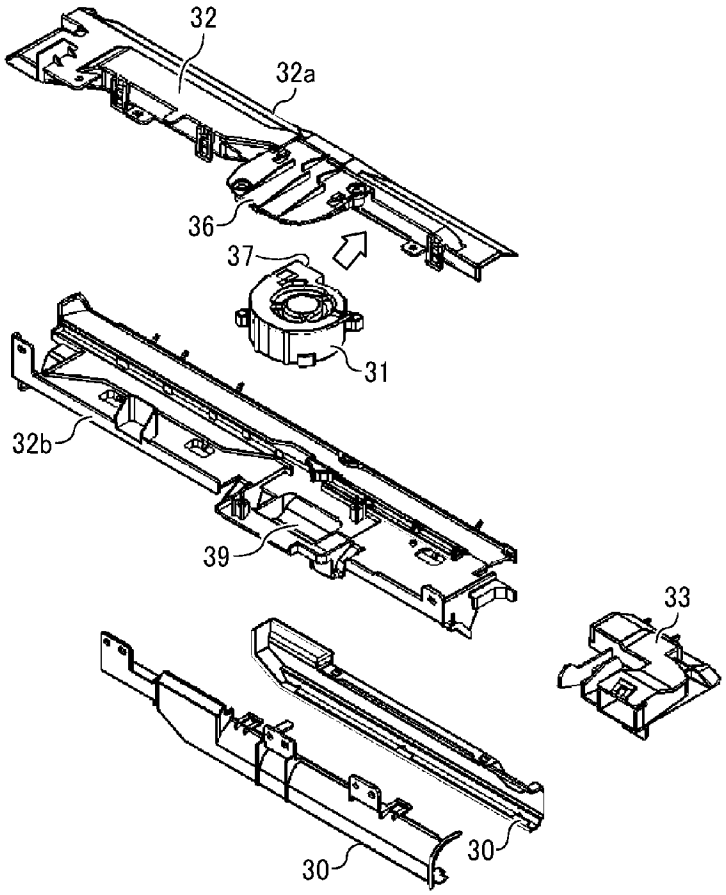
FIG. 3B is an exploded perspective view illustrating the cooling device of FIG. 3A.
Figure 3A:
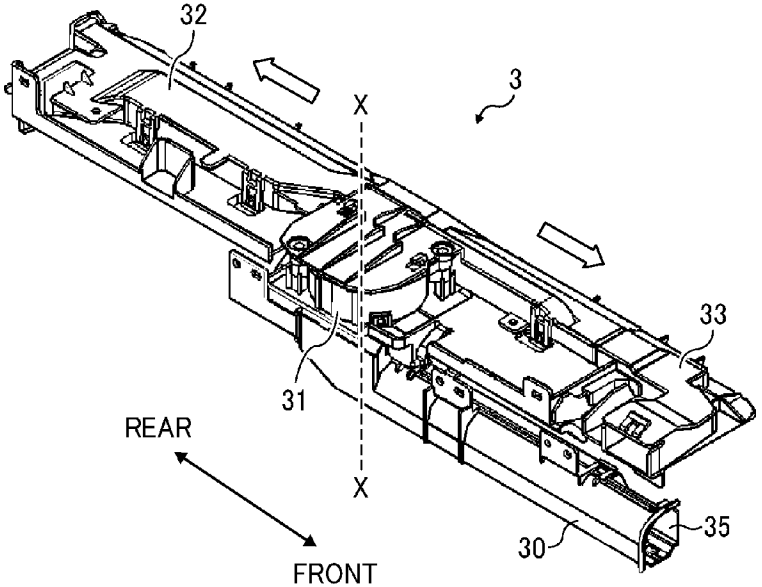
FIG. 3A is a perspective view illustrating the cooling device.

FIG. 2 is a schematic diagram illustrating a location of the cooling device 3 in the image forming apparatus 1. FIG. 3A is a perspective view illustrating the cooling device 3. FIG. 3B is an exploded perspective view illustrating the cooling device 3.

As illustrated in FIG. 2, the cooling device 3 is disposed at a center of an apparatus body of the image forming apparatus 1. In FIG. 2, a schematic configuration of a frame of the image forming apparatus 1 and the cooling device 3 disposed at a center in the frame of the image forming apparatus 1 are depicted. The air blowing fan 31 of the cooling device 3 is disposed at the center in a sheet width direction that intersects with the sheet conveying direction DA. At the same time, the air blowing fan 31 is disposed at the center of the image forming apparatus 1 in a left and right direction (a horizontal direction) of a front side of the image forming apparatus 1. The air intake guide 30 extends to the front side of the image forming apparatus 1. The air intake guide 30 has an opening 35 (see FIG. 3A) at one axial end to intake outside air and guide the outside air to the air blowing fan 31 inside the image forming apparatus 1. A front cover is attached to the front of the image forming apparatus 1. The front cover is openable and closable with respect to the image forming apparatus 1. A gap is formed between the front cover at a closed position and the opening 35. With this configuration, cold outside air is taken through the opening 35 to cool the interior of the image forming apparatus 1. It is to be noted that a louver may be disposed on the front cover that is disposed facing the opening 35.

As illustrated in FIG. 3A, the cooling device 3 includes the air blowing fan 31 that functions as an air blower. The air blowing fan 31 that blows air to the cooling target device is disposed inside the apparatus body of the image forming apparatus 1. The air blowing fan 31 is a sirocco fan, for example. As previously described, the cooling device 3 includes the air intake guide 30, the first duct 32 having air flowing passages, and the second duct 33 that is connected to the first duct 32. The air flowing passages of the first duct 32 are a first air flowing passage 51 and a second air flowing passage 52, both flowing air exhausted from an air exhaust port 37 of the air blowing fan 31. One end of the air intake guide 30 is connected to an air intake part of the air blowing fan 31 (a lower face of the air blowing fan 31).

As described above, an opposed end of the opening 35 extends near the front cover of the image forming apparatus 1, so as to intake outside air of the image forming apparatus 1. The air exhausted from the air blowing fan 31 flows in the first duct 32 in two different directions indicated by arrows in FIG. 3A. As described below, the air having passed through the right side (the front side) of the image forming apparatus 1 then flows in the first air flowing passage 51 and the second air flowing passage 52 of the first duct 32 and the inside of the second duct 33 that is connected to the first duct 32.

As described in FIG. 3A, the second duct 33 is bent. By extending the second duct 33, the air can be guided to a desired cooling target device. However, in a case in which the second duct 33 does not cool any other cooling target devices, the air may be exhausted from the air exhaust port without extending the second duct 33 as illustrated in FIG. 3A.

As illustrated in FIG. 3B, the first duct 32 includes an upper half body 32*a* and a lower half body 32*b*. The lower half body 32*b* that functions as a cover receives the air blowing fan 31 and the upper half body 32*a* that functions as a cover covers the air blowing fan 31. By so doing, the air blowing fan 31 is stowed in the first duct 32. In this configuration, the lower half body 32*b* and the upper half body 32*a* hold the air blowing fan 31 therebetween and form a cooling unit.

The air blowing fan 31 is disposed at the interior center of the apparatus body of the image forming apparatus 1. The air blowing fan 31 intakes air from a bottom face thereof and exhausts the air through the air exhaust port 37 formed on a front face thereof. In assembling, a cover 36 attached to the upper half body 32*a* covers an upper face of the air blowing fan 31 to protect the air blowing fan 31 from dust. The air blowing fan 31 is mounted on a vent 39 formed on the lower half body 32*b* of the first duct 32. One end of the air intake guide 30 is fitted to a lower opening of the vent 39. The air intake guide 30 includes two half bodies and extends straight. However, the one end of the air intake guide 30 is bent upwardly. The second duct 33 can be connected to one end of the first duct 32 near the front face of the apparatus body of the image forming apparatus 1. Accordingly, the first duct 32 and the second duct 33 define an air flowing passage directing the developing device 80 and the printed circuit board 4, both are the cooling target devices. FIG. 1 depicts the second duct 33 with the one end extended. The first air flowing passage 51 of the first duct 32 is connected to the second duct 33, and therefore the air that flows in the first air flowing passage 51 is guided to another cooling target device (the printed circuit board 4, in the present example) that has a temperature greater than a temperature of the air, so that the cooling target device having a higher temperature is cooled. The air flowing in the first air flowing passage 51 is heated by heat from the fixing device 9 to be used for preventing heat transfer in the second air flowing passage 52. However, since a specified temperature value of devices of the printed circuit board 4, for example, is greater than a temperature of airflow used for preventing heat transfer, the airflow can be reused as air for cooling a cooling target device.

Figure 4A:
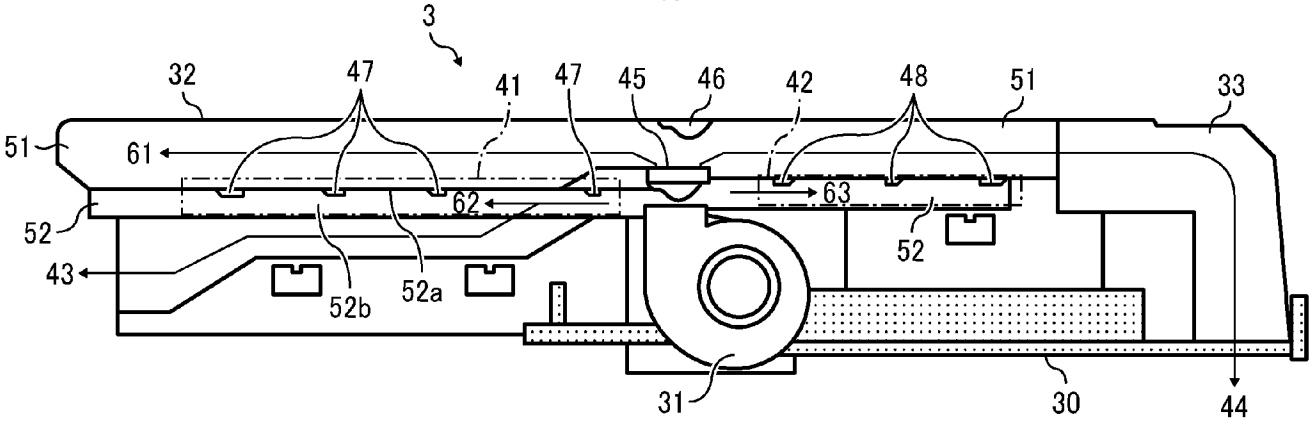
FIG. 4A is a plan view illustrating the cooling device.
Figure 4B:
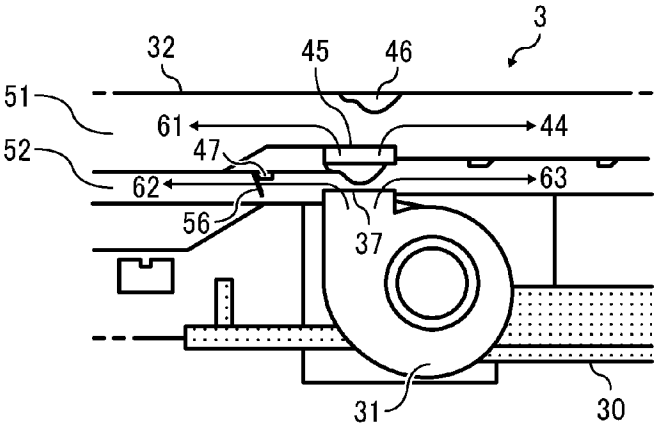
FIG. 4B is an enlarged view of a part of the cooling device of FIG. 4A.

FIG. 4A is a plan view illustrating the cooling device 3. FIG. 4B is an enlarged view of a part of the cooling device 3 of FIG. 4A.

The cooling device 3 includes the first air flowing passage 51 and the second air flowing passage 52 that are divided vertically. Each of the first air flowing passage 51 and the second air flowing passage 52 directs toward both ends in a sheet width direction that is a direction intersecting with or being perpendicular to the sheet conveying direction DA.

Further, the first air flowing passage 51 and the second air flowing passage 52 are branched and divided at a first projection 46 and a second projection 45, respectively, into respective two air flowing passages to flow the air exhausted from the air blowing fan 31 in a direction perpendicular to the air exhausting direction of the air blowing fan 31. Here, the first projection 46 projects from a bottom face of the first air flowing passage 51. Further, the second projection 45 projects from the second air flowing passage 52.

A top face of the second projection 45 is set to be equal to or higher than the bottom face of the first air flowing passage 51. Accordingly, since the first air flowing passage 51 and the second air flowing passage 52 both disposed close to the air blowing fan 31 are aligned in the same straight line, the cooling device 3 can be reduced in size.

The developing device 80 is disposed below the cooling device 3. A wall (a side wall) of the second air flowing passage 52 arranged facing the developing device 80 includes air exhaust openings (slits) 47 and 48 through which air flows toward the developing device 80. The second air flowing passage 52 is arranged near the air blowing fan 31. The second projection 45 that functions as an airflow divider is formed in the second air flowing passage 52. The first air flowing passage 51 is arranged far from the air blowing fan 31, specifically, is arranged downstream from the second projection 45 in an air flowing direction. The first projection 46 that functions as an airflow divider is formed in the first air flowing passage 51.

In a case in which the first duct 32 does not include any projections, air flows toward a wall of an air flowing passage. Further, if two air flowing passages are arranged close to each other for space saving, the cooling efficiency of the first duct 32 drops due to pressure loss.

In order to address this inconvenience, a projection is provided at an air dividing position in the air flowing passage, so as to smoothly guide air blown toward the air dividing position from the air blowing fan 31. By providing the projection to the air flowing passage, the cooling efficiency of the first duct 32 can increase and the space can be saved by defining the air flowing passage close to the air blowing fan 31.

The air exhaust openings 47 and 48 are formed on a side wall 52*a* and a bottom face 52*b* of the second air flowing passage 52. As illustrated in FIG. 4, each of the air exhaust openings 47 and 48 is formed across the side wall 52*a* and the bottom face 52*b* connected to each other. Four of the air exhaust openings 47 are formed at intervals in a region 41. The air exhaust openings 47 become greater in size as the position thereof is farther from the air blowing fan 31. In other words, the air exhaust openings 47 are greater in size toward the downstream side from the air blowing fan 31 in the air flowing direction. Three of the air exhaust openings 48 are formed at intervals in a region 42. The air exhaust openings 48 become greater in size as the position thereof is farther from the air blowing fan 31. In other words, the air exhaust openings 48 are greater in size toward the downstream side from the air blowing fan 31 in the air flowing direction. The sizes of the air exhaust openings 47 and 48 are changed because the pressure of airflow decreases as the distance from the air blowing fan 31 to the air exhaust openings 47 and 48 becomes greater. By changing the sizes of the air exhaust openings 47 and 48, a uniform amount of air passes through the air exhaust openings 47 and 48. Therefore, the amounts of air blowing in a longitudinal direction of the cooling device 3 to the developing device 80 also become even. Further, by providing an air exhaust opening or air exhaust openings along the air flowing passage extending from the air dividing position to an outlet part, the developing device 80 that functions as the cooling target device and that extends along the air flowing passage close to the air flowing passage can be cooled.

By forming an air exhaust opening on the bottom face connecting to the side wall, the air can be blown to the developing device 80 that functions as a cooling target device disposed in the lower part of the cooling device 3. In this case, it is preferable that the air exhaust opening on the bottom face is not vertical to the bottom face but obliquely downwardly to prevent occurrence of vortex of airflow. The reason of the recommendation is described below. In a case in which the cooling device 3 is disposed immediately above the developing device 80, any air exhaust openings are not formed on the side wall but are formed on the bottom face. That is, the cooling device 3 includes air exhaust openings 47 and 48 formed on the side wall of the second air flowing passage 52 facing the cooling target device to flow air toward the cooling target device.

As illustrated in FIG. 4A, the second projection 45 divides the airflow from the air blowing fan 31 into an airflow 62 and an airflow 63. The airflow 62 directs toward a rear side of the apparatus body in the second air flowing passage 52. Then, the airflow 62 flows in the region 41 and passes through the air exhaust openings 47 to cool the developing device 80 disposed below the cooling device 3. Further, part of the airflow 62 further branches to an airflow 43 to cool a toner collecting passage 82 (see FIG. 10) that functions as another cooling target device. By an doing, a different cooling target device can be cooled while the size of the duct is reduced.

By contrast, the airflow 63 directs toward a front side of the apparatus body in the second air flowing passage 52. Then, the airflow 63 flows in the region 42 and passes through the air exhaust openings 48 to cool the developing device 80 disposed below the cooling device 3. The airflow 62 and the airflow 63 travel in opposite directions to each other. In other words, the airflow 62 and the airflow 63 form an angle of substantially 180 degrees. This angle indicates that the second air flowing passage 52 is formed in a straight line.

No air exhaust opening is provided in the first air flowing passage 51.

As illustrated in FIG. 4A, the first projection 46 divides the airflow exhausted from the air blowing fan 31 into an airflow 61 and an airflow 44. The airflow 61 directs toward the rear side of the apparatus body in the first air flowing passage 51. Then, the airflow 61 cools the first air flowing passage 51 while passing therethrough and flows in an obliquely upward direction from an opening at a downstream end of the first air flowing passage 51 in the first duct 32. Accordingly, the airflow 61 is blown toward the fixing device 9 to cool the fixing device 9 to separate the heat generated by the fixing device 9 away from the cooling device 3.

By contrast, the airflow 44 directs toward the front side of the apparatus body in the first air flowing passage 51. Then, the airflow 44 flows in the first air flowing passage 51 while being deflected and guided by the second duct 33 that is connected to the first duct 32 to cool the printed circuit board 4. The airflow 61 and the airflow 44 travel in opposite directions to each other. In other words, the airflow 61 and the airflow 44 form an angle of substantially 180 degrees. This angle indicates that the first air flowing passage 51 is formed in a straight line.

As illustrated in FIG. 4B, the second projection 45 is disposed near the air blowing fan 31 at a position facing the air exhaust port 37 of the air blowing fan 31 and the first projection 46 is disposed far from the air blowing fan 31 behind the second projection 45 (i.e., downstream from the second projection 45 in the air flowing direction). Respective surfaces of the first projection 46 and the second projection 45 receive the airflow exhausted from the air blowing fan 31. Each of the first projection 46 and the second projection 45 has a surface having a moderate arch shaped surface or a curved surface, and therefore the airflow from the air exhaust port 37 of the air blowing fan 31 is smoothly divided into respective airflows (i.e., the airflows 62 and 63 and the airflows 61 and 44) moving from a center of each projection (i.e., the first projection 46 and the second projection 45) along the surface of the projection in the left and right directions.

As previously described, the second projection 45 divides the airflow into the airflow 62 and the airflow 63 and the first projection 46 divides the airflow into the airflow 61 and the airflow 44. The shape and position of the second projection 45 are determined such that the forces or speeds of the airflow 62 and the airflow 63 are substantially identical to each other.

It is to be noted that, due to reasons of design of the cooling device 3, the first projection 46 is arranged to be shifted to the right side from the center of the second projection 45. However, the configuration of the cooling device 3 is not limited thereto.

A lateral length of the air exhaust port 37 is substantially equal to a lateral length of the second projection 45.

A rib 56 is disposed downstream from an extreme upstream one of the air exhaust openings 47 in the air flowing direction. Specifically, the extreme upstream one of the air exhaust openings 47 is located at a closest position to the air blowing fan 31. The rib 56 is disposed projecting from the side wall 52*a* of the second air flowing passage 52 to guide the airflow 62 to the extreme upstream one of the air exhaust openings 47. The rib 56 is formed because an amount of airflow passing through the extreme upstream one of the air exhaust openings 47 is smaller than an amount of airflow passing through any one of the air exhaust openings 47 except the extreme upstream one due to various factors. Therefore, the rib 56 may not at all be provided to the cooling device 3 or, by contrast, may be provided to each of the air exhaust openings 47 and 48.

The first duct 32, the air intake guide 30, and the second duct 33 include a light and low-cost resin material having low thermal conductivity. Instead of the above-described light and lo-cost resin material, however, the upper half body 32*a* of the first duct 32 disposed near the fixing device 9 of high temperature includes a resin material having low thermal conductivity, and the lower half body 32*b* of the first duct 32 disposed close to the developing device 80 that functions as a cooling target device includes a metallic material having high thermal conductivity. Accordingly, heated air exerted from the fixing device 9 having h temperature becomes difficult to be conveyed to the first air flowing passage 51 and the developing device 80 (see FIG. 10). Further, heat from the developing device 80 can be easily taken to the first air flowing passage 51. By causing outside air to flow in the first air flowing passage 51, the first air flowing passage 51 and the developing device 80 disposed below the first air flowing passage 51 can be cooled effectively.

Figure 5:
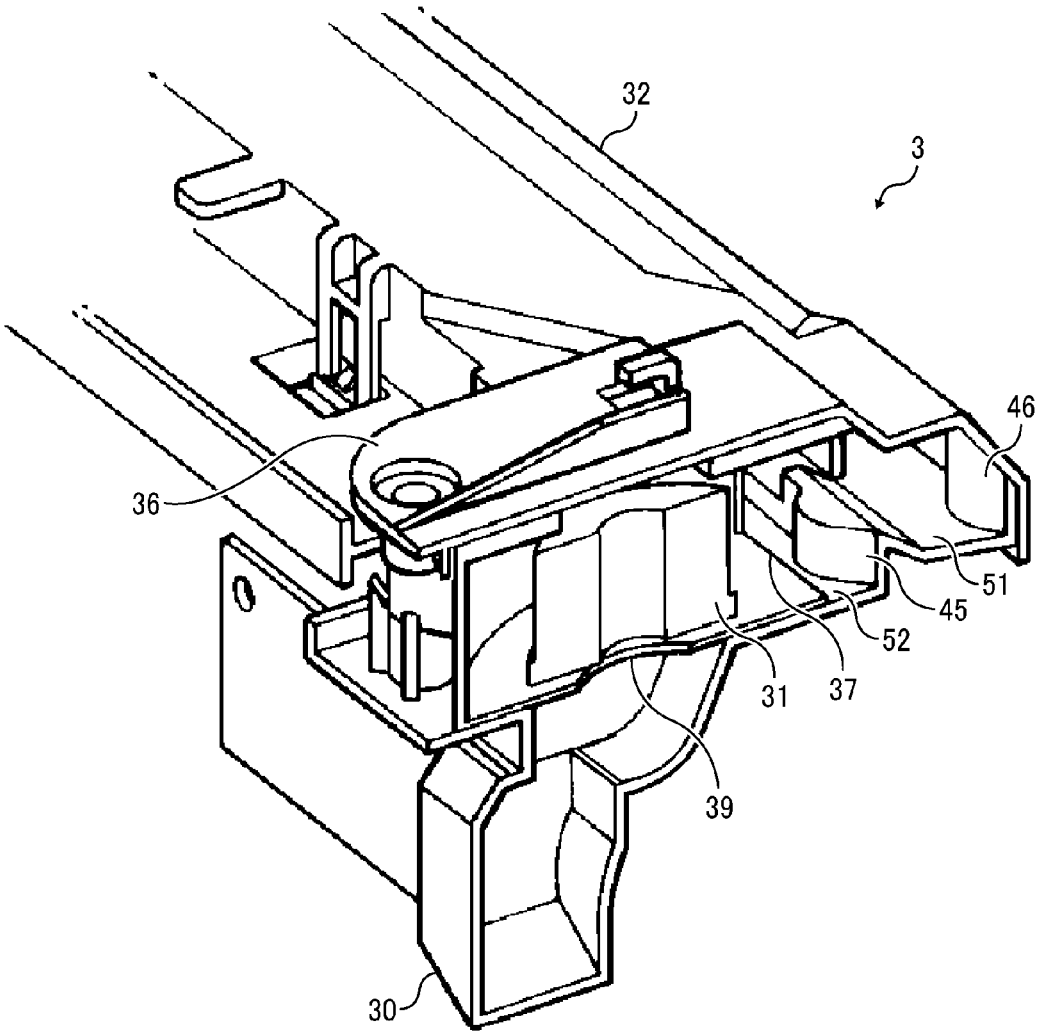
FIG. 5 is a cross sectional view illustrating the cooling device along a line X-X of FIG. 3A.

FIG. 5 is a cross sectional view illustrating the cooling device 3 along a line X-X of FIG. 3A.

As illustrated in FIG. 5, the second projection 45 is disposed at a lower part within a range of height of the air exhaust port 37 of the air blowing fan 31 and the first projection 46 is disposed at an upper part within the range of height of the air exhaust port 37 of the air blowing fan 31. In other words, a sum of the height of the second projection 45 and the height of the first projection 46 is substantially equal to the height of the air exhaust port 37 of the air blowing fan 31. According to this configuration, part of the airflow exhausted from the air exhaust port 37 blows against the second projection 45 disposed near the air blowing fan 31 to be divided into the airflow 62 and the airflow 63. The rest of the airflow exhausted from the air exhaust port 37 blows against the first projection 46 disposed beyond the second projection 45 to be divided into the airflow 61 and the airflow 44.

The first air flowing passage 51 and the second air flowing passage 52 are aligned along a direction perpendicular to a longitudinal direction of the cooling device 3 and divided vertically. The first air flowing passage 51 is located at a position higher than the second air flowing passage 52. It is to be noted that the first projection 46 is arranged to be shifted to the right side from the center of the second projection 45.

Figure 6:
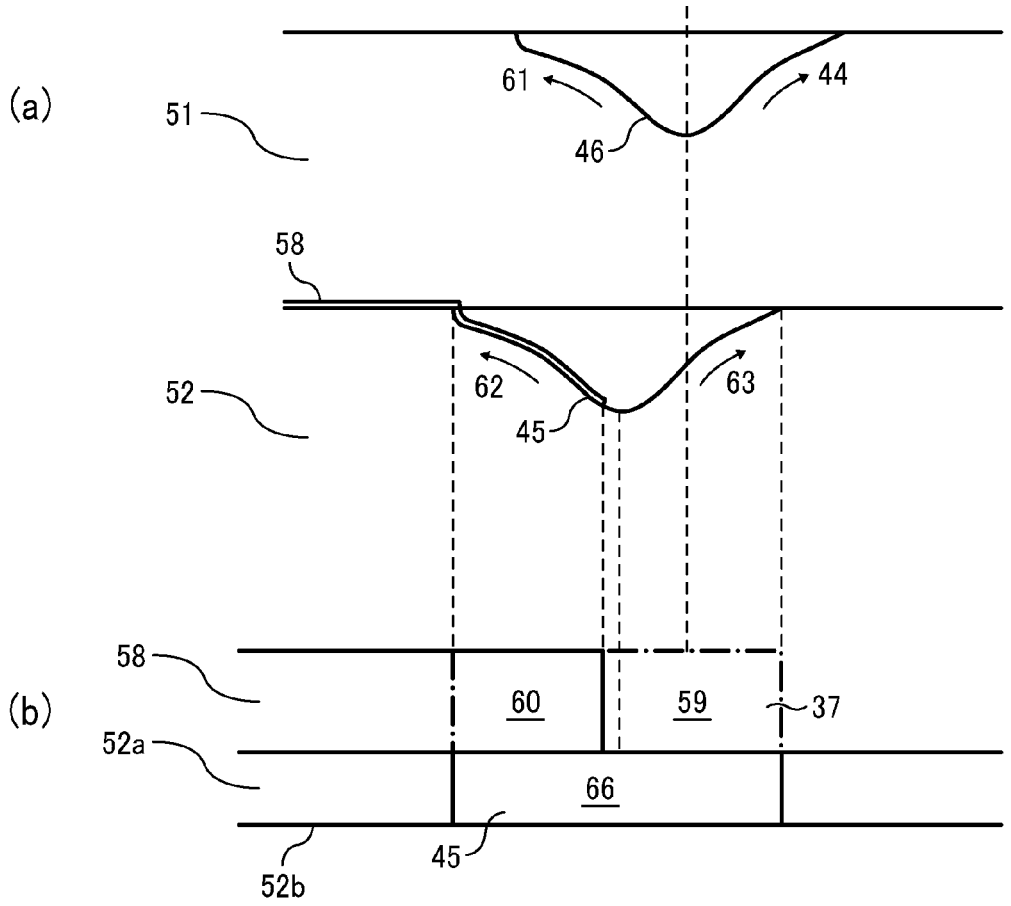
FIG. 6 is a diagram illustrating a part of the cooling device.

FIG. 6 is a diagram illustrating a part of the cooling device 3 according to the present embodiment of this disclosure. Drawing (a) of FIG. 6 is a plan view illustrating respective parts of the first projection 46 and the second projection 45. Drawing (b) of FIG. 6 is a schematic diagram illustrating the second projection 45, viewed from a front thereof (in an upward direction from below of the respective parts in (a) of FIG. 6). It is to be noted that the first projection 46 is omitted in (b) of FIG. 6.

The upper half body 32*a* includes a guide 58 and the lower half body 32*b* includes the second projection 45. As illustrated in (b) of FIG. 6, the guide 58 is located at an upper position of the second projection 45 when assembling the upper half body 32*a* and the lower half body 32*b*. As illustrated in (a) of FIG. 6, the guide 58 extends from a left side from the center of the second projection 45 toward the rear side of the apparatus body. Therefore, from the cross sectional view of (b) of FIG. 6, a rectangular area of the air exhaust port 37 indicated by a dashed-dotted line can be divided into an upper right area 59, an upper left area 60, and a lower area 66. The guide 58 is located in the upper left area 60. The second projection 45 is located in the lower area 66. The airflow exhausted through the air exhaust port 37 of the air blowing fan 31 is divided vertically into two airflows by the second projection 45. The airflow in the lower area 66 blows against the front surface of the second projection 45 into left and right airflows, which are the airflow 62 and the airflow 63. The airflow in the upper right area 59 flows toward the rear side of the apparatus body without any obstacles, and is divided by the first projection 46 of the first air flowing passage 51 into the left and right airflows, which are the airflow 61 and the airflow 44. The airflow in the upper left area 60 (the airflow 62) is guided by the guide 58 to be an airflow 43 to cool the toner collecting passage 82 (see FIG. 10).

The guide 58 covers part of the area of the air exhaust port 37 indicated by broken lines. Therefore, as illustrated in (a) of FIG. 6, the first projection 46 on the first air flowing passage 51 is arranged to be shifted to the right side from the center of the second projection 45. More specifically, the center of the first projection 46 meets the center of the upper right area 59. Accordingly, the airflow that passes through the upper right area 59 is divided by the first projection 46 to direct equally to the left and right sides.

Here, the above description has clearly been given of branching the airflow exhausted from the air exhaust port 37 of the air blowing fan 31. However, the airflow may not be divided into three areas by the second projection 45 and the guide 58.

Further, a width (the left and right direction in FIG. 6) of the air exhaust port 37 and a width of the second projection 45 are substantially equal to each other. Therefore, when compared with a comparative cooling device having an oblique shape or a gently curved shape, the configuration of the cooling device 3 according to the present embodiment as illustrated in FIG. 6 can achieve a reduction in vertical size of the cooling device 3.

FIGS. 7A through 7D are plan views illustrating various shapes of the air exhaust opening 48 and various directions of airflow through the air exhaust opening 48. FIGS. 7A through 7D indicate the air exhaust opening 48, viewed from top of the cooling device 3, which is the same as FIGS. 4A and 4B.

The airflow passes through an air flowing passage defined by a side wall 55 and a bottom face 54 of the first duct 32. The air exhaust opening 48 is formed on the side wall 55. After passing through the air exhaust opening 48, the airflow blows against the cooling target device.

Figure 7A:
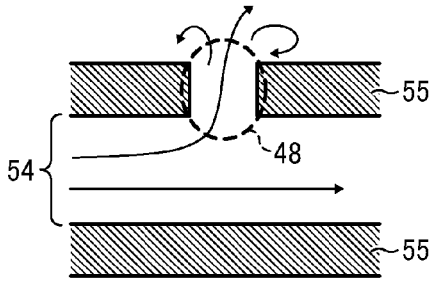
FIGS. 7A through 7D are plan views illustrating various shapes of an air exhaust opening and various directions of airflow through the air exhaust opening.

Here, as illustrated in FIG. 7A, in a case in which the air exhaust opening 48 is formed on the side wall 55 in a direction perpendicular to the air flowing direction, a pressure difference at steps increases to generate vortex of air. This vortex of air may generate wind noise.

Figure 7B:
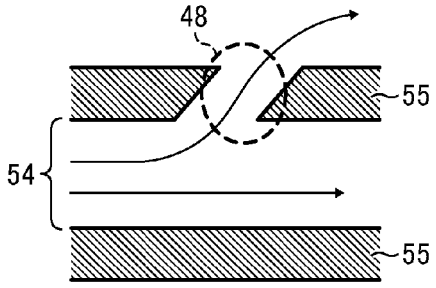

In order to address this inconvenience, as illustrated in FIG. 7B, the air exhaust opening 48 is formed on the side wall 55 to extend diagonally to the air flowing direction. To be more specific, the air exhaust opening 48 is formed on the side wall 55 diagonally from an upstream side to a downstream side in the air flowing direction. Accordingly, the airflow passing through the air exhaust opening 48 and the airflow passing in the air flowing passage without passing through the air exhaust opening 48 form an acute angle, as illustrated in FIG. 7B. With this configuration, the pressure difference at steps is reduced and the airflow passing through the air flowing passage changes gently. By so doing, occurrence of vortex of air can be restrained, and therefore occurrence and size of the wind noise can be reduced.

The air exhaust opening 47 is made on an opposite side of the side wall 55 facing an opposite direction to the air exhaust opening 48 in FIG. 7B.

It is to be noted that, while having different sizes from each other in FIG. 4A, the air exhaust openings 47 and 48 in FIG. 7B have an identical angle relative to the side wall. However, the configuration is not limited thereto. For example, the air exhaust openings 47 and 48 may have different angles relative to the side wall, so as to change an angle of the airflow blowing against the cooling target device.

In the present embodiment, the developing device 80 that functions as a cooling target device is located obliquely below the cooling device 3. Therefore, it is preferable that the air exhaust opening 48 is formed obliquely downwardly, that is, extending downwardly on the side wall 55, as illustrated in FIG. 7D.

Figure 7C:
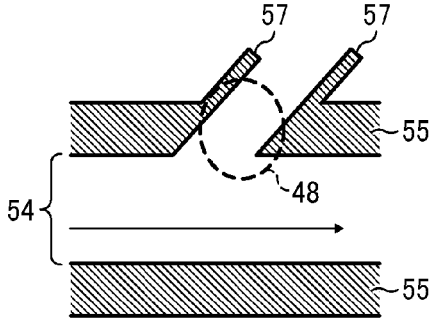
Figure 7D:
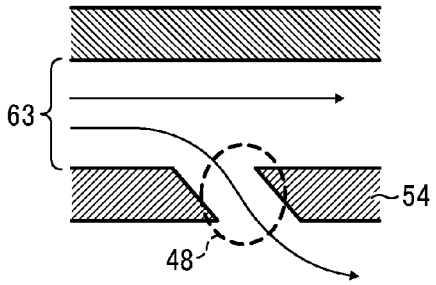

FIG. 7C is a plan view illustrating a variation of the air exhaust opening 48.

A guide ribs 57 is disposed on an outer wall that surrounds the air exhaust opening 48 mounted obliquely on the side wall 55. The guide rib 57 extends to a downstream side in the air flowing direction toward the developing device 80. With this configuration having the guide rib 57, the airflow can be guided to the cooling target device more reliably. At this time, it is preferable that an air inlet port does not project from the side wall 55.

Figure 8A:
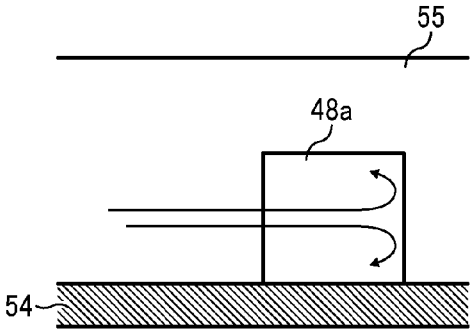
FIGS. 8A and 8B are diagrams illustrating various shapes of the air exhaust opening formed on a side wall, viewed facing a front of the side wall.
Figure 8B:
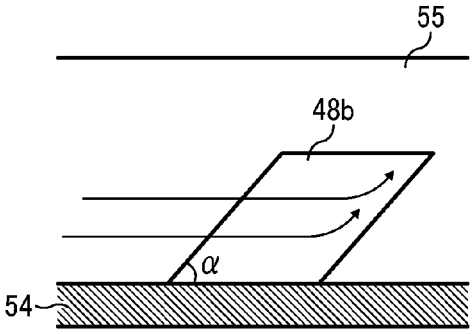

FIGS. 8A and 8B are diagrams illustrating various shapes of an air exhaust opening (an air exhaust opening 48*a* in FIG. 8A and an air exhaust opening 48*b* in FIG. 8B) formed on the side wall 55, viewed facing a front of the side wall having the air exhaust openings thereon (viewed from a user standing on the bottom face 54).

In a case in which the air exhaust opening 48*a* having a rectangular shape is formed in the air flowing passage, as illustrated in FIG. 8A, the airflow blows against the side wall 55 vertically. Therefore, the airflow is disturbed to generate vortex of air easily.

In order to address this inconvenience, the air exhaust opening 48*b* extends diagonally relative to the air flowing direction, as illustrated in FIG. 8B. The air exhaust opening 48*b* having a parallelogram shape is formed on the side wall 55. The air exhaust opening 48*b* extends diagonally upwardly from the bottom face 54 disposed adjacent to the side wall 55 toward the downstream side in the air flowing direction. Therefore, an angle $\alpha$ of the air exhaust opening 48*b* at an upstream side in the air flowing direction is an acute angle. Due to a cross sectional shape of parallelogram of the air exhaust opening 48*b*, the airflow can be moderately guided to the outside of the duct, so that the level of noise can be reduced.

Figure 9:
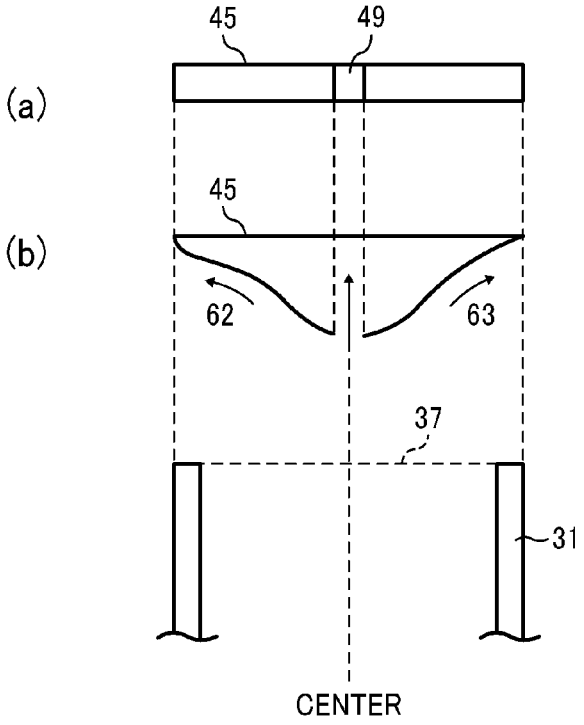
FIG. 9 is a diagram illustrating another configuration of the second projection as a variation to the present embodiment of this disclosure.

FIG. 9 is a diagram illustrating another configuration of the second projection 45 as a variation to the present embodiment of this disclosure.

Drawing (a) of FIG. 9 is a front view illustrating another configuration of the second projection 45 as a variation to the present embodiment of this disclosure. Drawing (b) of FIG. 9 is a plan view illustrating the second projection 45 of (a) of FIG. 9.

In the configuration of (a) of FIG. 9, the second projection 45 having a moderate arch shaped surface is formed with respect to the center in the lateral width direction of the air exhaust port 37 of the air blowing fan 31. In addition, an opening 49 having a rectangular shape is formed at the center of the second projection 45, so that the airflow passes through the opening 49 toward the developing device 80. It is to be noted that the shape of the opening 49 is not limited to a rectangular shape but can be any other shape as long as the opening 49 is symmetrically formed. For example, the opening 49 may have a round shape. The airflow exhausted through the air exhaust port 37 of the air blowing fan 31 and blown against the second projection 45 is divided vertically into an air flow to pass through the opening 49 and blow against the developing device 80, the airflow 62 to flow to the rear side of the apparatus body, and the airflow 63 to flow to the front side of the apparatus body. With the configuration having the opening 49, the developing device 80 disposed below the second projection 45 can further be cooled, and the amount of airflow in the longitudinal direction of the cooling device 3 toward the developing device 80 can be more even. The airflow exhausted from the air exhaust port 37 of the air blowing fan 31 straightly hits the second projection 45. Therefore, the size of the opening 49 may be relatively small, as illustrated in (a) of FIG. 9, and the shape of the opening 49 is at least formed in a symmetrical shape. The size of the opening 49 is selected, for example, such that an amount of the airflow 62 and the amount of the airflow 63 flowing in opposite directions (left and right directions) are equal or such that respective speeds of the airflow 62 and the airflow 63 are not reduced.

Figure 10:
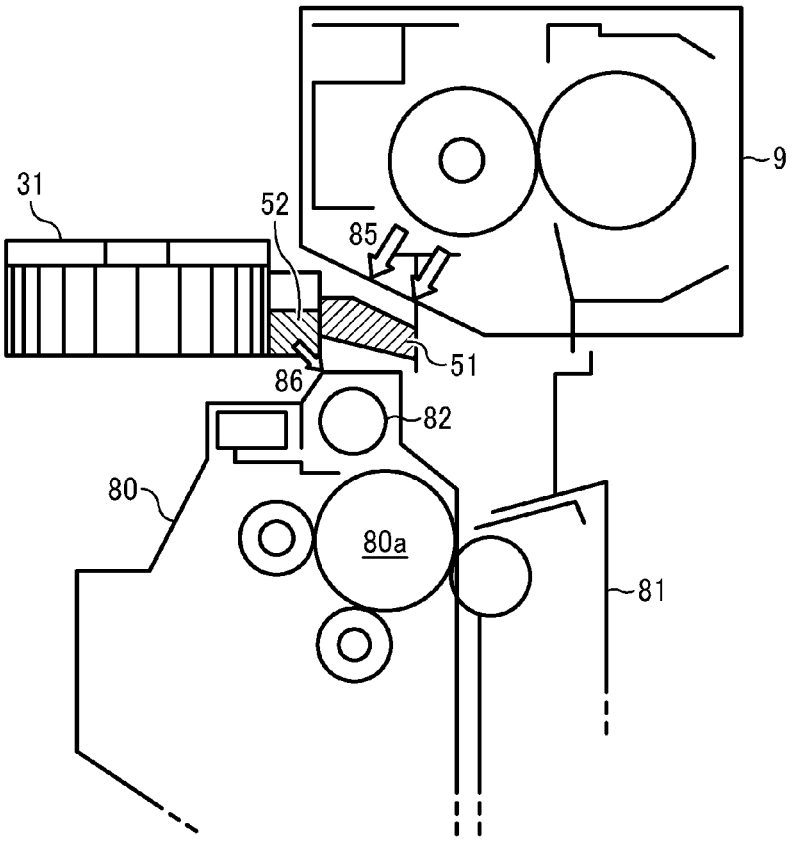
FIG. 10 is a schematic partial cross sectional view illustrating an interior of the image forming apparatus.

FIG. 10 is a schematic partial cross sectional view illustrating an interior of the image forming apparatus 1.

The developing device 80 that functions as a cooling target device is disposed in the direction intersecting with the air flowing direction in the air flowing passage. An airflow 86 exhausted from the air exhaust openings 47 and 48 exits downwardly from the second air flowing passage 52 to blow an upper part of the developing device 80. Further, the first air flowing passage 51 and the second air flowing passage 52 are aligned along a longitudinal direction of the developing device 80. In addition, the first air flowing passage 51 is located closer to the fixing device 9 that functions as a heat generator than the second air flowing passage 52 and between the fixing device 9 and the second air flowing passage 52. To be more specific, the first air flowing passage 51 and the second air flowing passage 52 are divided vertically into two steps. The first air flowing passage 51 is located to the fixing device 9 than the second air flowing passage 52. Accordingly, the first air flowing passage 51 functions as a heat transfer prevention layer or an air layer to restrain heated air (an airflow 85) from the heated fixing device 9 to be transmitted to the developing device 80 and the second air flowing passage 52. The first air flowing passage 51 can reduce an increase in temperature of the toner collecting passage 82 that is disposed in an upper part of the developing device 80 and an increase in temperature of air in the second air flowing passage 52. The toner collecting passage 82 is used to collect and resupply toner unused for development of toner image. By preventing an increase in temperature of the toner collecting passage 82, the toner in the toner collecting passage 82 is also prevented from being melted.

As described above, the cooling device 3 according to the present embodiment of this disclosure aligns two divided air flowing passages on the same straight line. By so doing, the cooling device 3 including the first duct 32 and the second duct 33 can be reduced in size. Further, by providing the air exhaust opening(s) along the air flowing passage between the air dividing position and the outlet part, the cooling target device disposed close to the air flowing passage can be cooled. Consequently, various types of cooling target devices can be cooled by air blown by a compact cooling device.

Further, comparative image forming apparatuses develop a toner image on a recording medium in a developing device before fixing the toner image to the recording medium in a fixing device. Therefore, as the size of an image forming apparatus decreases, a position of the fixing device and a position of the developing device become closer at a distance. Due to this configuration, the temperature of the air is heated by the fixing device when the air is to cool the fixing device. Accordingly, the developing device is not cooled sufficiently or the temperature of the developing device is increased due to the heated air.

By contrast, the cooling device 3 according to the present embodiment of this disclosure has the second air flowing passage 52 used for cooling a cooling target device or cooling target devices and the first air flowing passage 51 used for preventing heat transfer aligned separately. As a result, an increase in temperature of the airflow in the second air flowing passage 52 can be restrained or prevented. In other words, one air flowing passage is additionally disposed between an air flowing passage for cooling and the fixing device to prevent heat transfer, so as to prevent an increase in temperature of cool air to be blown against the developing device. Further, heat transfer prevention and cooling are performed by one duct. Therefore, even if the duct is disposed near the fixing device, the developing device can be cooled effectively. In addition, the airflow used for preventing heat transfer can be reused for cooling a printed circuit board or other cooling target devices. Consequently, this disclosure can achieve a cooling device that is a compact type, that can convey air to various types of cooling target devices, and that does not cause cool air to be susceptible to heat even if the cooling device is disposed near the fixing device functioning as a heat generator.

Further, in a case in which the airflows exhausted from the air exhaust openings 47 and 48 of the second air flowing passage 52 can cool the developing device 80 sufficiently, the first air flowing passage 51 that mainly functions as a heat transfer prevention layer may be omitted. For example, the cooling device 3 may have the second air flowing passage 52 without the first air flowing passage 51, as illustrated in FIG. 11.

Figure 11:
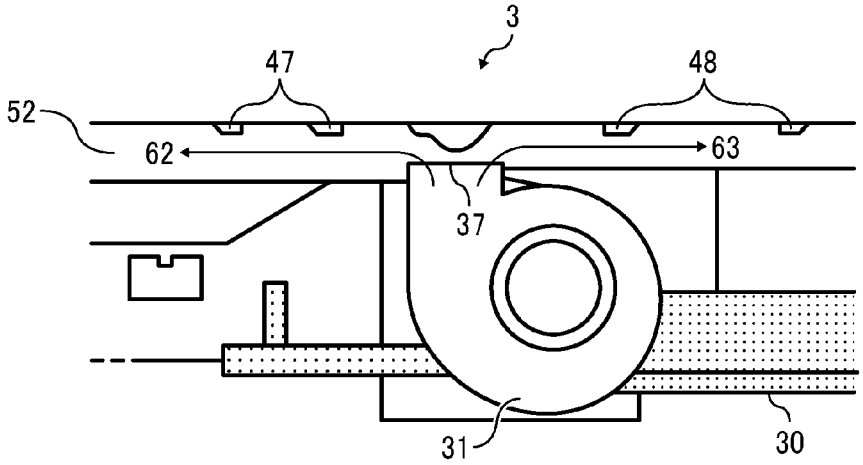
FIG. 11 is a plan view illustrating the cooling device.

FIG. 11 is a plan view illustrating the cooling device 3 without the first air flowing passage 51.

Further, the cooling device 3 according to the present embodiment of this disclosure includes two air flowing passages but the configuration of a cooling device is not limited thereto. For example, the cooling device may include three air flowing passages. Further, the cooling device may include one or two second air flowing passages for cooling and two or one first air flowing passage for preventing heat transfer. The second air exhaust opening for cooling the cooling target device has an air exhaust opening or openings on a wall disposed facing the cooling target device, so that air passes through the air exhaust opening(s) toward the cooling target device. Further, depending on the configuration, the first air flowing passage for preventing heat transfer may have an air exhaust opening or openings on the wall disposed facing the cooling target device, so that air passes through the air exhaust opening(s) toward the cooling target device.

Figure 12:
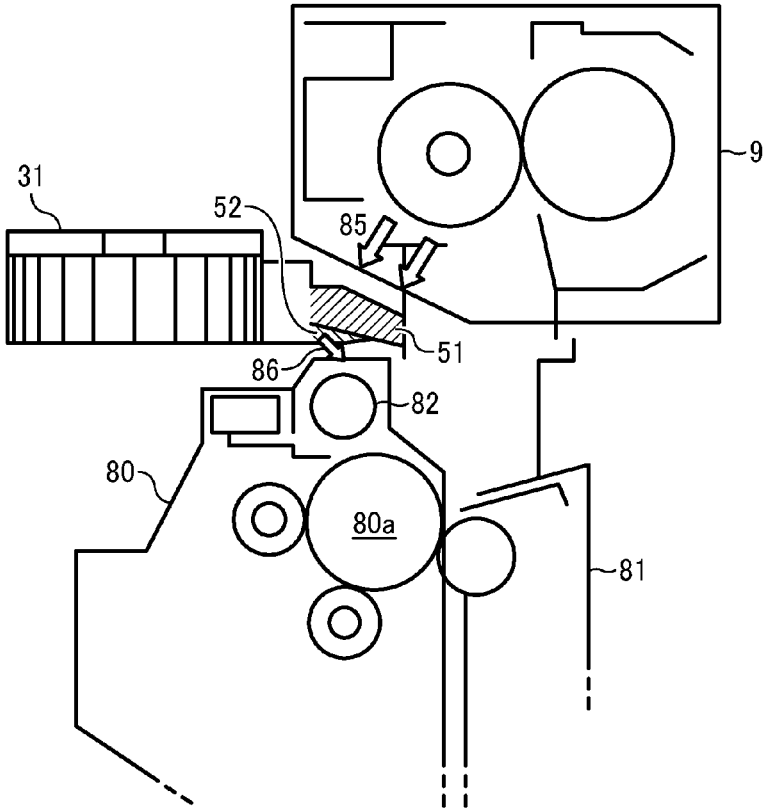
FIG. 12 is a schematic partial cross sectional view illustrating an interior of the image forming apparatus.

Now, FIG. 12 is a schematic partial cross sectional view illustrating an interior of the image forming apparatus 1. As illustrated in FIG. 12, the second air flowing passage 52 may be entirely moved downwardly to be disposed below the first air flowing passage 51.

In this case, the air exhaust openings 47 and 48 are formed on the bottom face 52*b*. By so doing, the airflow in the second air flowing passage may not be directly susceptible to heat generated by the fixing device 9 due to the first air flowing passage 51.

Figure 13:
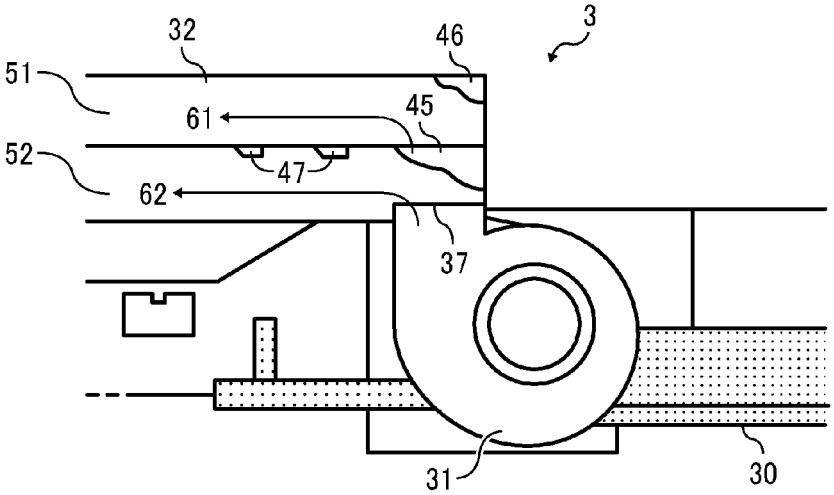
FIG. 13 is a plan view illustrating the cooling device according to another example of the present embodiment of this disclosure.

Further, each of the first air flowing passage 51 and the second air flowing passage 52 causes divided airflows to flow to the left and right sides. However, the configuration of the air flowing passage is not limited thereto. For example, FIG. 13 is a plan view illustrating the cooling device 3 according to another example of this disclosure. As illustrated in FIG. 13, the first air flowing passage 51 and the second air flowing passage 52 do not branch to the left and right sides but extend in one direction. Consequently, a positional relation of the first air flowing passage and the second air flowing passage in the vertical direction illustrated in FIG. 10 and FIG. 12 can be applied.

Further, it is preferable that the image forming apparatus 1 according to the present embodiment of this disclosure includes the developing device 80 including an image bearer that bears a toner image thereon, the fixing device 9 that functions as a heat generator to fix the toner image to the recording sheet 7, and the cooling device 3 disposed between the developing device 80 and the fixing device 9.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A cooling device comprising:

an air blower to blow air toward a cooling target device, the air blower having an air exhaust port;

an air flowing passage that receives the air from the air blower;

an airflow divider projecting into the air flowing passage from a side wall of the air flowing passage toward the air exhaust port of the air blower to divide the air exhausted from the air exhaust port of the air blower into at least two airflows such that an air flowing direction of the air is changed to a direction perpendicular to an air exhausting direction of the air;

the at least two airflows divided by the airflow divider pass through the air flowing passage, the air flowing passage having a wall disposed facing the cooling target device; and an air exhaust opening disposed on the wall of the air flowing passage to cause the air to pass through toward the cooling target device disposed in a direction intersecting the air flowing direction in the air flowing passage, wherein the airflow divider is disposed facing a center in a width direction of the air exhaust port of the air blower, and wherein the airflow divider has an opening at a center to flow the air toward the cooling target device.

2. The cooling device according to claim 1, wherein the air exhaust opening is disposed on the wall diagonally from an upstream side to a downstream side in the air flowing direction.

3. The cooling device according to claim 1, wherein, when viewed from a front side of the wall on which the air exhaust opening is disposed, the air exhaust opening extends diagonally relative to the air flowing direction.

4. The cooling device according to claim 1, wherein the air exhaust opening includes multiple air exhaust openings at intervals, and wherein the multiple air exhaust openings are greater in size toward a downstream side from the air blower in the air flowing direction.

5. The cooling device according to claim 1, further comprising a guide disposed on an outer wall surrounding the air exhaust opening and extending toward the cooling target device.

6. The cooling device according to claim 1, wherein the air flowing passage includes a first air flowing passage having no air exhaust opening and a second air flowing passage having the air exhaust opening, wherein the first air flowing passage and the second air flowing passage are aligned along a longitudinal direction of the cooling target device, and wherein the first air flowing passage is located closer to a heat generator included in an image forming apparatus than the second air flowing passage.

7. The cooling device according to claim 6, wherein the airflow divider divides the air exhausted from the air blower into two airflows in the second air flowing passage, and wherein one of the two airflows branches to another airflow directing toward another cooling target device.

8. The cooling device according to claim 1, wherein a lateral length of the airflow divider is equal to a lateral length of the air exhaust opening.

9. An image forming apparatus comprising:

a developing device including an image bearer to bear a toner image;

a fixing device to fix the toner image transferred from the image bearer onto a recording medium; and the cooling device according to claim 1 disposed between the developing device and the fixing device.

10. The cooling device according to claim 1, wherein the air flowing passage includes:

a first air flowing passage and a second air flowing passage to cause an airflow of the air exhausted from the air blower to pass through, each of the first air flowing passage and the second air flowing passage extending in an air flowing direction perpendicular to an air exhausting direction of the air, the second air flowing passage having a wall disposed facing the cooling target device, the first air flowing passage disposed between the second air flowing passage and a heat generator included in an image forming apparatus and aligned with the second air flowing passage.

11. The cooling device according to claim 10, wherein the air exhaust opening is disposed between the first air flowing passage and the cooling target device.

12. The cooling device according to claim 10, wherein the first air flowing passage and the second air flowing passage are aligned along a longitudinal direction of the cooling target device, and wherein the first air flowing passage is located closer to the heat generator than the second air flowing passage.

13. The cooling device according to claim 10, wherein the first air flowing passage and the second air flowing passage are divided vertically.

14. The cooling device according to claim 10, further comprising an airflow divider to divide the air exhausted from the air blower into at least two airflows to pass through one of the first air flowing passage and the second air flowing passage, the airflow divider having a curved surface against which the air exhausted from the air blower blows.

15. The cooling device according to claim 10, wherein the airflow passing through the first air flowing passage is guided toward another cooling target device having a temperature higher than the airflow.

16. An image forming apparatus comprising:

a developing device including an image bearer to bear a toner image, the developing device being the cooling target device;

a fixing device to fix the toner image transferred from the image bearer onto a recording medium, the fixing device being the heat generator; and the cooling device according to claim 10 disposed between the developing device and the fixing device.

17. The cooling device according to claim 10, further comprising:

a first cover and a second cover disposed between which the air blower is held, the second cover including the first air flowing passage and the second air flowing passage to flow the air exhausted from the air blower, each extending in an air flowing direction perpendicular to the air exhausting direction of the air exhausted from the air blower.

18. An image forming apparatus comprising:

a developing device including an image bearer to bear a toner image;

a fixing device to fix the toner image transferred from the image bearer onto a recording medium; and a cooling device disposed between the developing device and the fixing device, the cooling device including:

an air blower to blow air toward a cooling target device, the air blower having an air exhaust port;

an air flowing passage that receives the air from the air blower;

an airflow divider projecting into the air flowing passage from a side wall of the air flowing passage toward the air exhaust port of the air blower to divide the air exhausted from the air exhaust port of the air blower into at least two airflows such that an air flowing direction of the air is changed to a direction perpendicular to an air exhausting direction of the air;

the at least two airflows divided by the airflow divider pass through the air flowing passage, the air flowing passage having a wall disposed facing the cooling target device; and an air exhaust opening disposed on the wall of the air flowing passage to cause the air to pass through toward the cooling target device disposed in a direction intersecting the air flowing direction in the air flowing passage.

19. The cooling device according to claim 18, wherein the air flowing passage includes:

a first air flowing passage and a second air flowing passage to cause an airflow of the air exhausted from the air blower to pass through, each of the first air flowing passage and the second air flowing passage extending in an air flowing direction perpendicular to an air exhausting direction of the air, the second air flowing passage having a wall disposed facing the cooling target device, the first air flowing passage disposed between the second air flowing passage and a heat generator included in an image forming apparatus and aligned with the second air flowing passage.

* * * * *